US007554046B2

(12) United States Patent
Gasparyan et al.

(10) Patent No.: US 7,554,046 B2
(45) Date of Patent: Jun. 30, 2009

(54) LIQUID SWITCH

(75) Inventors: Arman Gasparyan, Gillette, NJ (US); Thomas Nikita Krupenkin, Warren, NJ (US); Joseph Ashley Taylor, Springfield, NJ (US); Donald Weiss, Cresskill, NJ (US)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 0 days.

(21) Appl. No.: 12/173,889

(22) Filed: Jul. 16, 2008

(65) Prior Publication Data

US 2008/0273281 A1 Nov. 6, 2008

Related U.S. Application Data

(62) Division of application No. 11/379,507, filed on May 23, 2006, now Pat. No. 7,449,649.

(51) Int. Cl.
*H01H 57/00* (2006.01)

(52) U.S. Cl. ..... 200/182; 200/193

(58) Field of Classification Search ..... 200/181–193, 200/209–219, 233–236
See application file for complete search history.

(56) References Cited

U.S. PATENT DOCUMENTS 4,652,710 A * 3/1987 Karnowsky et al. ..... 200/235
6,185,961 B1 2/2001 Tonucci et al.
6,323,447 B1 11/2001 Kondoh et al.
6,743,991 B1 * 6/2004 Wong et al. ..... 200/182
6,756,552 B2 * 6/2004 Takenaka et al. ..... 200/224
6,759,611 B1 * 7/2004 Wong et al. ..... 200/182
6,774,325 B1 * 8/2004 Wong et al. ..... 200/182
6,777,630 B1 * 8/2004 Dove et al. ..... 200/182
6,781,074 B1 * 8/2004 Fong et al. ..... 200/182
6,787,720 B1 * 9/2004 Wong ..... 200/182
6,794,591 B1 * 9/2004 Wong ..... 200/182
6,879,089 B2 * 4/2005 Wong et al. ..... 310/328
6,891,315 B2 * 5/2005 Wong ..... 310/328
6,924,443 B2 * 8/2005 Wong et al. ..... 200/182
7,005,593 B2 2/2006 Gasparyan et al.
7,071,432 B2 * 7/2006 Lindsey ..... 200/182
7,164,090 B2 1/2007 Beerling
7,189,934 B2 3/2007 Youngner
7,211,754 B2 5/2007 Wang et al.
2004/0191127 A1 9/2004 Kornblit et al.
2005/0039661 A1 2/2005 Kornblit et al.
2005/0069458 A1 3/2005 Hodes et al.
2005/0106459 A1 5/2005 Kroupenkine et al.
2005/0203613 A1 9/2005 Arney et al.

(Continued)

OTHER PUBLICATIONS

Kim et al.; "Nanostructured Surfaces for Dramatic Reduction of Flow Resistance in Droplet-Based Microfluidics", IEEE (2002), pp. 479-482.

(Continued)

*Primary Examiner*—Michael A Friedhofer
*Assistant Examiner*—Lisa N Klaus

(57) ABSTRACT

An apparatus comprising a liquid switch. The liquid switch comprises a substrate having a surface with first and second regions thereon and a fluid configured to contact both of the regions. The regions each comprise electrically connected fluid-support-structures, wherein each of the fluid-support-structures have at least one dimension of about 1 millimeter or less. The regions are electrically isolated from each other.

13 Claims, 12 Drawing Sheets

U.S. PATENT DOCUMENTS

| | | | |
|---|---|---|---|
| 2005/0208370 | A1 | 9/2005 | Hodes et al. |
| 2005/0211505 | A1 | 9/2005 | Kroupenkine et al. |
| 2005/0217984 | A1 | 10/2005 | Gasparyan et al. |
| 2006/0040375 | A1 | 2/2006 | Arney et al. |
| 2006/0255171 | A1 | 11/2006 | Krupenkin et al. |
| 2007/0048858 | A1 | 3/2007 | Aizenberg et al. |
| 2007/0056853 | A1 | 3/2007 | Aizenberg et al. |
| 2007/0058483 | A1 | 3/2007 | Aizenberg et al. |
| 2007/0059213 | A1 | 3/2007 | Aizenberg et al. |
| 2007/0059489 | A1 | 3/2007 | Hodes et al. |
| 2007/0059510 | A1 | 3/2007 | Krupenkin et al. |
| 2007/0237025 | A1 | 10/2007 | Krupenkin et al. |
| 2007/0237937 | A1 | 10/2007 | Aizenberg et al. |
| 2007/0272528 | A1 | 11/2007 | Gasparyan et al. |

OTHER PUBLICATIONS

Kim et al.; "A Micromechanical Switch with Electrostatically Driven Liquid-Metal Droplet"; Sensors Actuators A-Phys 97-8, Apr. 1, 2002.

Latorre, et al.; "Electrostatic Actuation of Microscale Liquid Metal Droplets", Journal of Microelectromechanical Systems, Aug. 2002. vol. 11, No. 4, pp. 302-308.

U.S. Appl. No. 10/803,565, filed Mar. 18, 2004, entitled "Reserve Cell-Array Nanostructured Battery", to Hodes et al., currently pending.

U.S. Appl. No. 10/803,576, filed Mar. 18, 2004 entitled "Nanostructured Battery Having End of Life Cells"; to Kroupenkin et al., currently pending.

* cited by examiner

LIQUID SWITCH

This Application is a Divisional of prior application Ser. No. 11/379,507 filed on May 23, 2006, now U.S. Pat. No. 7,449,649 to Arman Gasparyan, et al. entitled, "A LIQUID SWITCH", currently allowed. The above-listed Application is commonly assigned with the present invention and is incorporated herein by reference as if reproduced herein in its entirety under Rule 1.53(b).

TECHNICAL FIELD OF THE INVENTION

The present invention is directed, in general, to electrically actuated switches, and in particular, liquid switches.

BACKGROUND OF THE INVENTION

Electrically actuated micromechanical switches, such as relays, have widespread application in a variety of electrical devices, such as integrated circuit devices. These switches can advantageously give lower on-resistance and higher off-resistance than semiconductor switching devices, for instance. They also have low leakage currents, thereby reducing the device's power requirements. Micromechanical switches are not without problems, however.

One problem with micromechanical switches is that the moving components of the switch wear out over time. Repeated use can cause the switch to fail, resulting in a decrease in the operable lifetime of the electrical device that the switch actuates. Another problem is that movable components of a switch that is not used frequently can become stuck or fused together, resulting in switch failure. The problem of mechanical wear or sticking are exacerbated as the dimensions of the switch are scaled down. Another problem is the increasing complexity of the manufacturing processes associated with integrating moveable micromechanical components into increasingly smaller devices.

SUMMARY OF THE INVENTION

To address one or more of the above-discussed deficiencies, one embodiment of the present invention is an apparatus. The apparatus comprises a liquid switch. The liquid switch comprises a substrate having a surface with first and second regions thereon and a fluid configured to contact both of the regions. The regions each comprise electrically connected fluid-support-structures, wherein each of the fluid-support-structures have at least one dimension of about 1 millimeter or less. The regions are electrically isolated from each other.

Another embodiment is a method. The method comprises reversibly actuating a liquid switch. The switch is turned to an on-position by applying a first voltage between a fluid and above-described first region. The switch is turned to an off-position by applying a second voltage between the fluid and the above-described second region of the electrically connected fluid-support-structures.

Still another embodiment is a method. The method comprises manufacturing a liquid switch. The method includes forming a plurality of the above-described electrically connected fluid-support-structures on a surface of a substrate. The method also includes forming first and second regions on the surface. Each of the regions comprise different ones of the fluid-support-structures and the first and second regions are electrically isolated from each other. The method further comprises placing a fluid on the surface, where the fluid is able to reversibly move between the first and second regions.

BRIEF DESCRIPTION OF THE DRAWINGS

Various embodiments can be understood from the following detailed description, when read with the accompanying figures. Various features may not be drawn to scale and may be arbitrarily increased or reduced in size for clarity of discussion. Reference is now made to the following descriptions taken in conjunction with the accompanying drawings, in which.

DETAILED DESCRIPTION

Figure 1A:
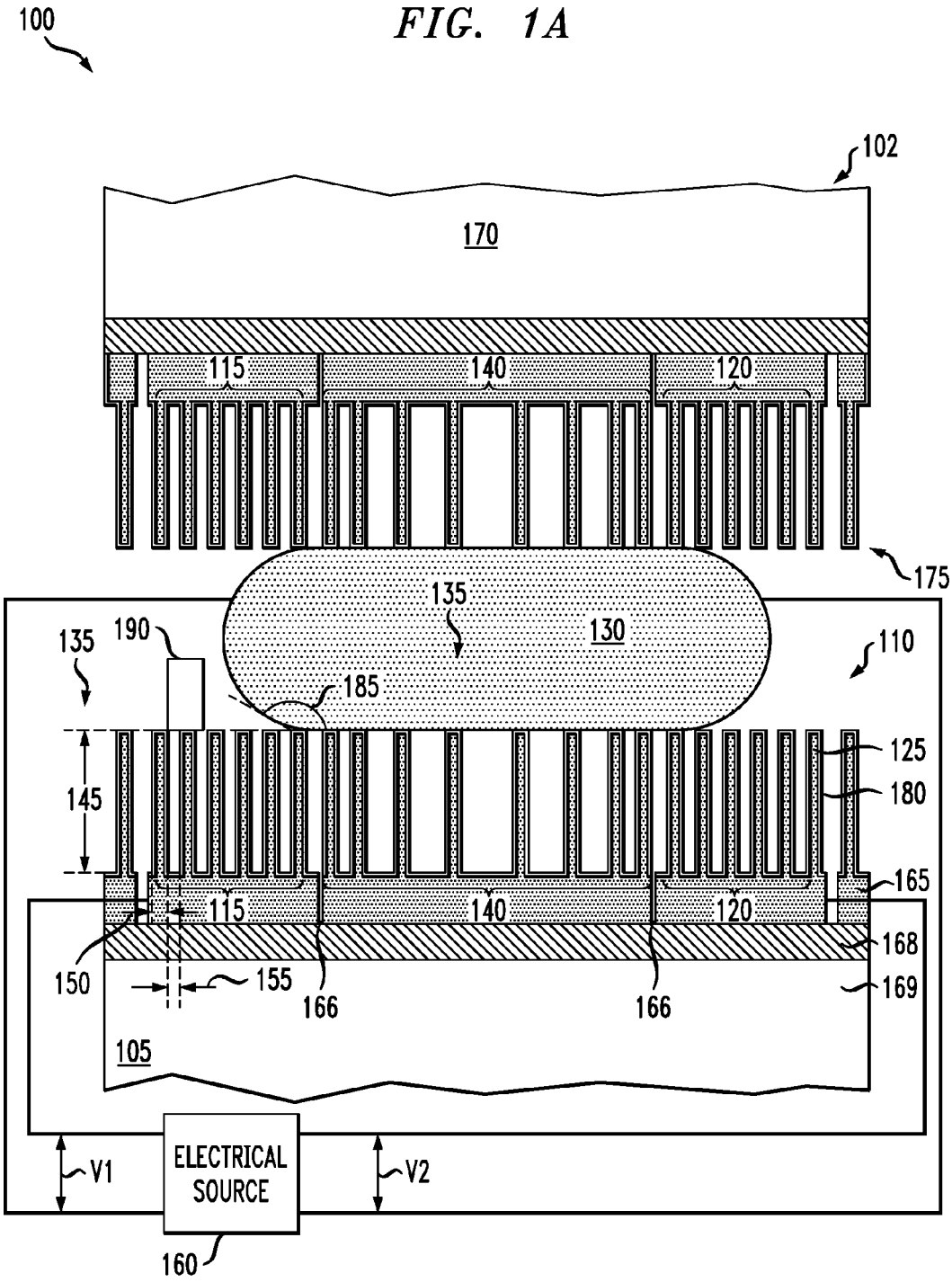
FIG. 1A presents a cross-sectional view of an exemplary embodiment of an apparatus.
Figure 1B:
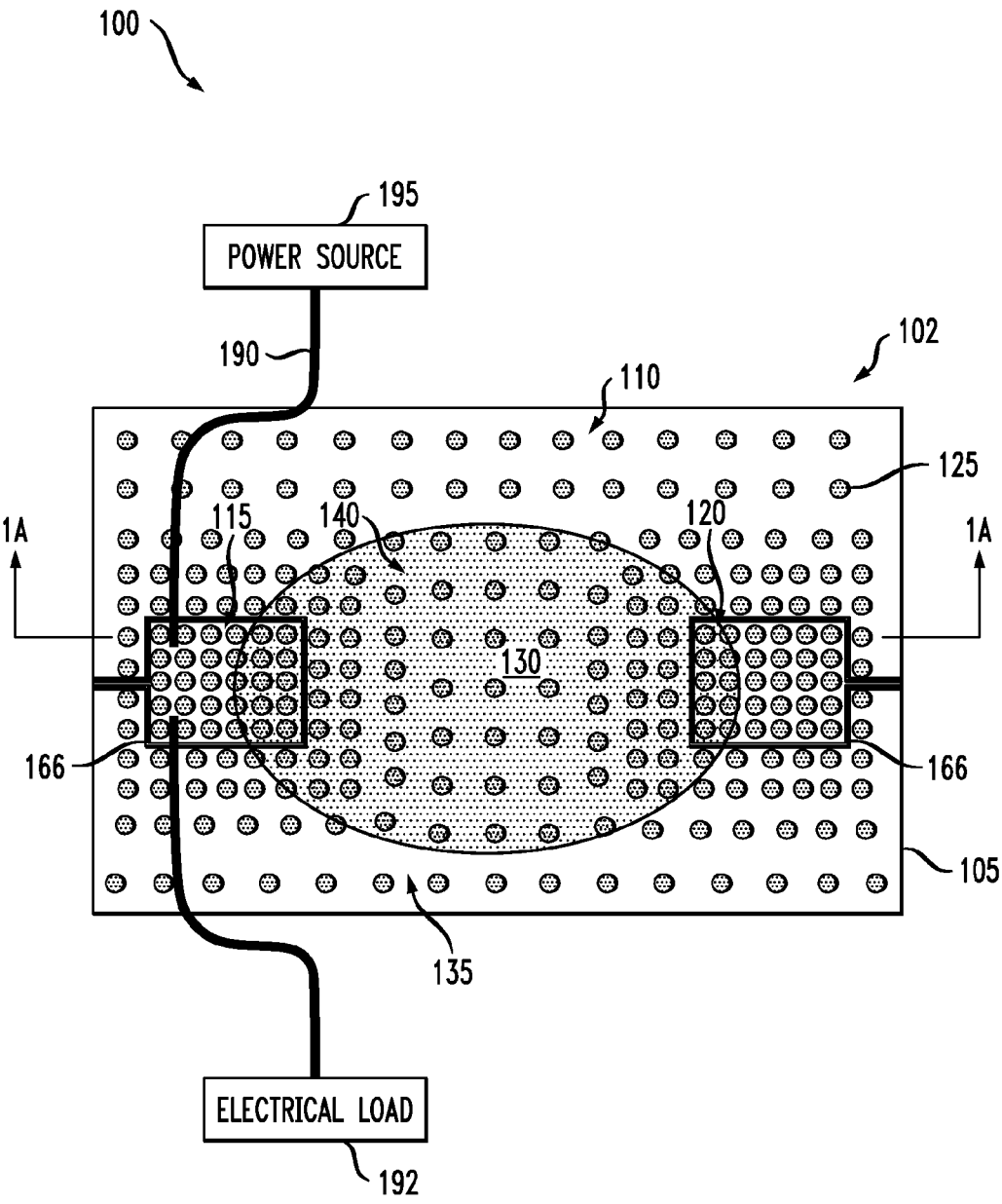
FIG. 1B presents a plan view of the exemplary apparatus shown in FIG. 1.

One embodiment is an apparatus. FIG. 1A presents a detailed cross-sectional view of an exemplary embodiment of an apparatus 100. FIG. 1B presents a plan view of the apparatus 100 but at a lower magnification. The cross-sectional view shown in FIG. 1*a* corresponds to view line 1-1 in FIG. 1B. Turning to FIG. 1A, the apparatus 100 comprises a liquid switch 102. The liquid switch 102 comprises a substrate 105 having a surface 110 with first and second regions 115 120 thereon. The regions 115, 120 each comprise electrically connected fluid-support-structures 125. Each of the fluid-support-structures 125 has at least one dimension of about 1 millimeter or less. The regions 115, 120 are electrically isolated from each other. The apparatus 100 further comprises a fluid 130 that is configured to contact both of the regions 115, 120.

Each fluid-support-structure 125 can be a nanostructure or microstructure. The term nanostructure as used herein refers to a predefined raised feature on a surface that has at least one dimension that is about 1 micron or less. The term microstructure as used herein refers to a predefined raised feature on a surface that has at least one dimension that is about 1 millimeter or less. The term fluid 130 as used herein refers to any liquid that is locatable on the fluid-support-structures 125.

It is desirable to configure the two regions 115, 120 such that the position of the fluid 130 will be stable when the fluid 130 is in one of these two locations. In some preferred embodiments of the apparatus 100, for example, the first and second region 115, 120 has a high areal density (e.g., the number of fluid-support-structures 125 per unit area of the surface 110). That is, the areal density of the fluid-support-structures 125 in these regions 115, 120 is greater than an areal density of the fluid-support-structures 125 in other portions or regions 135 of the surface 110. The fluid-support-structures 125 in these two regions 115, 120 can have different areal densities, although sometimes it is preferable for them to have the same areal density.

A high areal density of fluid-support-structures 125 in the first and second regions 115, 120 can facilitate the movement of the fluid 130 towards either of the two regions 115, 120. The high areal density also helps to prevent the fluid 130 from moving away from either of the two regions 115, 120, thereby stabilizing the location of the fluid 130. In some cases, the areal density in the first and second regions 115, 120 ranges from about 0.05 to about 0.5 fluid-support-structures 125 per square micron.

As further illustrated in FIG. 1A, there can be a gradient of areal densities of the fluid-support-structures 125 between the first and second regions 115, 120. The gradient can be discontinuous or gradual. For the apparatus 100 shown in FIG. 1A, for instance, the areal density of fluid-support-structures 125 in a third region 140 between the first and second regions 115, 120 gradually decreases to about 10 to 20 percent of the areal density in the first and second regions 115, 120.

The fluid-support-structures 125 on the surface 110 need not have the same shape and dimensions, although this is sometimes advantageous. For example, the fluid-support-structures 125 on the surface 110 of the substrate 105 shown in FIG. 1A all comprise posts having the same height 145 (e.g., one value in the range from 2 to 100 microns) and width 150 (e.g., one value that is about 1 micron or less). The term post, as used herein, includes any structures having round, square, rectangular or other cross-sectional shapes. For example, the fluid-support-structures 125 in the first and second regions 115, 120 depicted in FIG. 1A are post-shaped, and more specifically, cylindrically-shaped posts. In this embodiment, the increased areal density is achieved by decreasing the separation 155 between adjacent fluid-support-structures 125 (e.g., separations in the range from 0.1 to 20 microns).

Figure 2:
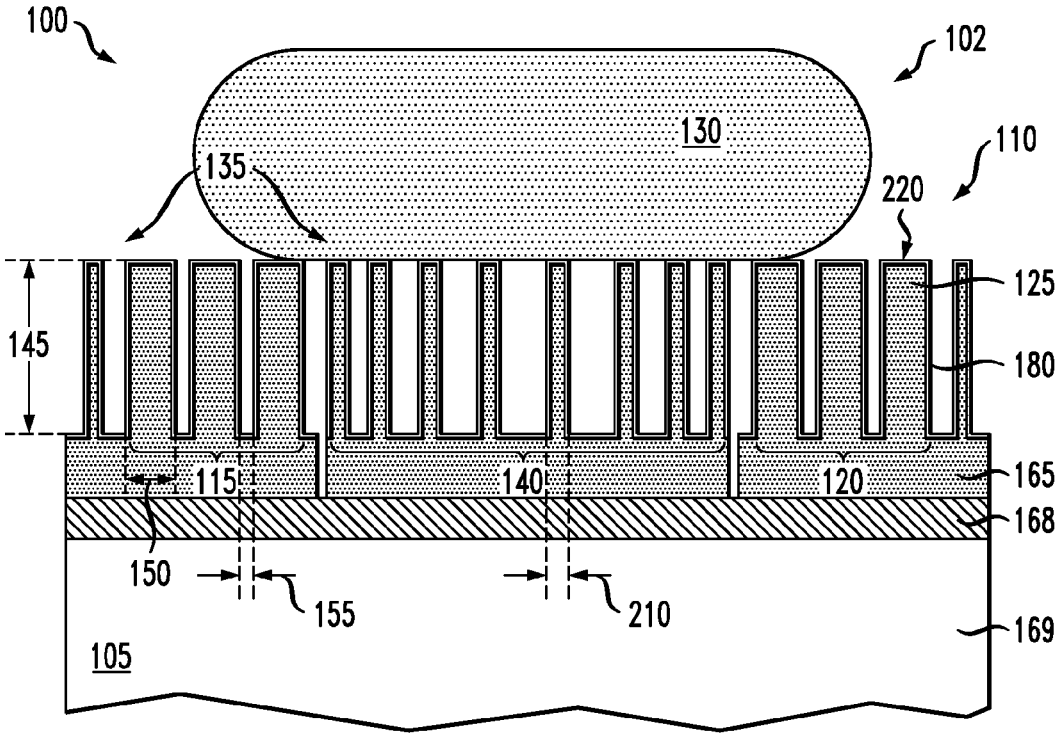
FIG. 2 presents a cross-sectional view of an alternative exemplary embodiment of an apparatus.

Alternatively, the dimensions of the fluid-support-structures 125 can be altered to promote the movement of the fluid 130 to, and prevent the movement of fluid 130 away from, either one of the two regions 115, 120. FIG. 2 shows a cross-sectional view of such an alternative embodiment of an apparatus 200, using the same reference numbers to depict analogous structures to that shown in FIG. 1A. As illustrated in FIG. 2, the width 150 of the fluid-support-structures 125 in the first and second regions 115, 120 is greater than the width 210 of the fluid-support-structures 125 in other regions 135 of the surface 110. In some cases, for example, the width 150 of fluid-support-structures 125 in these regions 115, 120 is about 2 to 10 times larger than the width 210 of the fluid-support-structures 125 in other regions 135. In some cases, the total area occupied by the top surfaces 220 of the fluid-support-structures 125 is up to 10 percent of the total area of one of the regions 115, 120.

Consequently, a total surface area of top surfaces 220 of the fluid-support-structures 125 on the surface 110 in the first and second regions 115, 120 is greater than a total surface area of top surfaces 220 of the fluid-support-structures 125 in a similar-sized region in other regions 135 of the surface 110. Analogous to having a high areal density (FIG. 1A), the higher total surface area of top surfaces 220 of fluid-support-structures 125 facilitates the movement of the fluid 130 to, and helps prevent further movement away from, either one of the two regions 115, 120. It should be noted that in such embodiments, however, the areal density of fluid-support-structures 125 in the first and second regions 115, 120 could be less than the areal density in the other regions 135 of the surface 110. Additionally the separation 155 between fluid-support-structures 125 in these regions 115, 120 could be the same or different than the separation between fluid-support-structures 125 in these regions than in the other regions 135 of the surface 110.

Returning to FIG. 1A, the movement of the fluid 130 back and forth between the first and second regions 115, 120 can be further controlled by applying of a voltage between the fluid 130 and the electrically connected fluid-support-structures 125 in one of the two regions 115, 120. As illustrated in FIG. 1A, the apparatus 100 can further comprise an electrical source 160. The electrical source 160 is configured to separately apply voltages to the fluid-support-structure 125 in the first or second regions 115, 120 (V1 and V2, respectively). For the fluid 130 to be optimally actuated by the voltages V1, V2, it is preferable for the fluid 130 to always contact both regions 115 and 120.

For instance, the electrical source 160 can be configured to apply a non-zero voltage to the fluid-support-structures 125 in one of the first or said second regions 115, 120 and a zero voltage to the other of the first or said second regions 115, 120. The fluid 130 can be moved to the first region 115, for example, by applying a non-zero voltage (e.g., $V1 \neq 0$) to the fluid-support-structures 125 in the first region 115 and a zero voltage (e.g., $V2=0$) to the fluid-support-structures 125 in the second region. Alternatively, the fluid 130 can be moved to the second region 120 by applying a non-zero voltage (e.g., $V2 \neq 0$) to the fluid-support-structures 125 in the second region 120, and a zero voltage (e.g., $V1=0$) to the fluid-support-structures 125 in the first region 115.

As illustrated in FIG. 1A, the fluid-support-structures 125 can be formed on an electrically conductive base layer 165 to facilitate the electrical connection between fluid-support-structures 125 in each of the regions 115, 120. Moreover, the conductive base layer 165 can have openings 166 to ensure that the fluid-support-structures 125 in the first region 115 are electrically isolated from the fluid-support-structures 125 in the second region 120 or other regions 135.

Some configurations of the substrate 105 facilitate forming the electrical connection of the fluid-support-structures 125 through the base layer 165. For example, the substrate 105 can comprise a planar semiconductor substrate, and more preferably, a silicon-on-insulator (SOI) wafer. The SOI substrate 105 comprises an upper layer of silicon that corresponds to the base layer 165. The SOI substrate 105 also has an insulating layer 168, comprising silicon oxide, and lower layer 169, comprising silicon. Of course, in other embodiments, the substrate 105 can comprise a plurality of planar layers made of other types of conventional materials.

One of ordinary skill in the art would understand how to select the volume of fluid 130 that is suitable for the dimensions of the switch 102. Preferably, the volume of fluid 130 is sufficient to span portions of both regions 115, 120, such that a voltage can be applied between the fluid 130 and the fluid-support-structures 125 in either of these regions. In some embodiments, for example, the volume of the fluid 130 ranges from about 1 to 500 microliters.

The fluid 130 can comprise any material capable of conducting electricity. In some cases, the fluid 130 is a melt of an organic salt. Preferably, the organic salt has a melting point that is below the operating temperature of the apparatus. In some cases, for example, the melting point of the organic salt is below room temperature (e.g., about 22° C. or less). Examples of suitable organic salts include imadazolium tetrafluoroborate.

As also illustrated in FIG. 1A, the liquid switch 102 can further comprise a second substrate 170 having a second surface 175 with the first and second regions 115, 120 thereon. The second surface 175 opposes the surface 110 of the first substrate 105, and the fluid 130 is located between the first and second surfaces 110, 175. Having two opposing surfaces 110, 175 with the first and second regions 115, 120 thereon advantageously impedes the inadvertent movement of the fluid 130, due to movement of the apparatus 100, for example. Situating the fluid 130 between two substrates 105, 170 also helps to prevent the fluid's 130 inadvertent evaporation.

As further illustrated in FIG. 1A, the electrically connected fluid-support-structures 125 and the base layer 165 can have a coating 180 that comprises an electrical insulator. For example, when the fluid-support-structures 125 and base layer 165 both comprise silicon, the coating 180 can comprise an electrical insulator of silicon oxide. In such embodiments, the coating 180 prevents current flowing through the base layer 165 or the fluid-support-structures 125 when the voltage is applied between the fluid-support-structures 125 and the fluid 130.

In some preferred embodiments, it is desirable for the coating 180 to also comprise a low surface energy material. The low surface energy material facilitates obtaining a high contact angle 185 (e.g., about 140 degrees or more) of the fluid 130 on the surface 110. The term low surface energy material, as used herein, refers to a material having a surface energy of about 22 dyne/cm (about $22\times10^{-5}$ N/cm) or less. Those of ordinary skill in the art would be familiar with the methods to measure the surface energy of materials.

In some instances, the coating 180 can comprise a single material, such as Cytop® (Asahi Glass Company, Limited Corp. Tokyo, Japan), a fluoropolymer that is both an electrical insulator and low surface energy material. In other cases, the coating 180 can comprise separate layers of insulating material and low surface energy material. For example, the coating 180 can comprise a layer of a dielectric material, such as silicon oxide, and a layer of a low-surface-energy material, such as a fluorinated polymer like polytetrafluoroethylene.

As further illustrated in FIGS. 1A and 1B, the liquid switch 102 can also comprise one or more conductive lines 190 configured to couple the switch 102 to an electrical load 192. It should be noted that the second substrate 170 is not shown in FIG. 1B so that underlying structures can be more clearly depicted. The liquid switch 102 can, for example, comprise two conductive lines 190 in the first region 115. In certain preferred embodiments, the conductive lines 190 comprise a metal or metal alloy that is resistant to corrosion caused by contacting the fluid 130. In some cases, the conductive lines 190 comprise gold, silver, platinum or other noble metal, or mixture thereof.

As further illustrated in FIG. 1B, the conductive lines 190 can couple an electrical load 192 of the apparatus 100, through the switch 102, to a power source 195 of the apparatus 100 when the fluid 130 is located in the first region 115. The electrical load 192 can comprise one or both of passive or active devices that draw current from the power source 195, such as a light or integrated circuit, respectively. The power source 195 can comprise any conventional device capable of delivering an AC or DC voltage to the electrical load 192 such as a battery.

Of course, some embodiments of the apparatus 100 can have a plurality of the liquid switches 102. For example, a matrix of switches 102 can be used to actuate power to a load 192 comprising multiple components in a telecommunication network.

As noted above, the fluid-support-structures 125 can be laterally separated from each other. This may be the case, as illustrated in FIGS. 1A and 1B, when each of the fluid-support-structures 125 in the first and second regions 115, 120 comprises a post. In other cases, however, the fluid-support-structures 125 are laterally connected. This may be the case, when the fluid-support-structures comprise cells.

Figure 3:
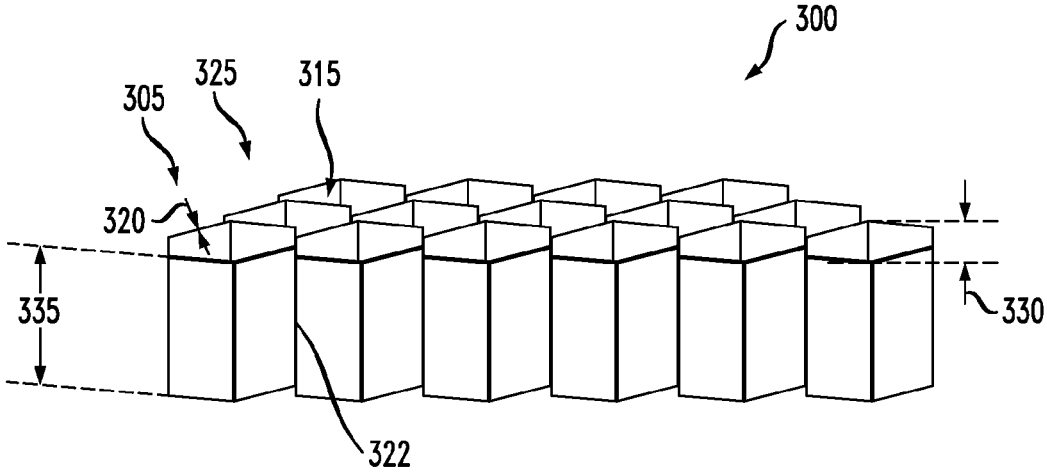
FIG. 3 presents a perspective view of fluid-support-structures that comprise one or more cells.

As an example, FIG. 3 presents a perspective view of fluid-support-structures 300 that comprise one or more cells 305. The term cell 305, as used herein, refers to a structure having walls 310 that enclose an open area 315 on all sides except for the side over which the fluid could be disposed. In such embodiments, the one dimension that is about 1 micrometer or less is a lateral thickness 320 of walls 310 of the cell 305. As illustrated in FIG. 3, the fluid-support-structures 300 are laterally connected to each other because the cell 305 shares at least one wall 322 with an adjacent cell 325. In certain preferred embodiments, a maximum lateral width 330 of each cell 305 is about 15 microns or less and a maximum height 335 of each cell wall is about 50 microns or less. For the embodiment shown in FIG. 3, each cell 305 has an open area 315 prescribed by a hexagonal shape. However, in other embodiments of the cell 305, the open area 315 can be prescribed by circular, square, octagonal or other shapes. The fluid-support-structures 300 can comprise closed-cells having internal walls that divide an interior of each of the closed-cells into a single first zone and a plurality of second zones, as described as described in U.S. patent application Ser. No. 11/227,663, which is also incorporated by reference in it entirety.

Figure 4A:
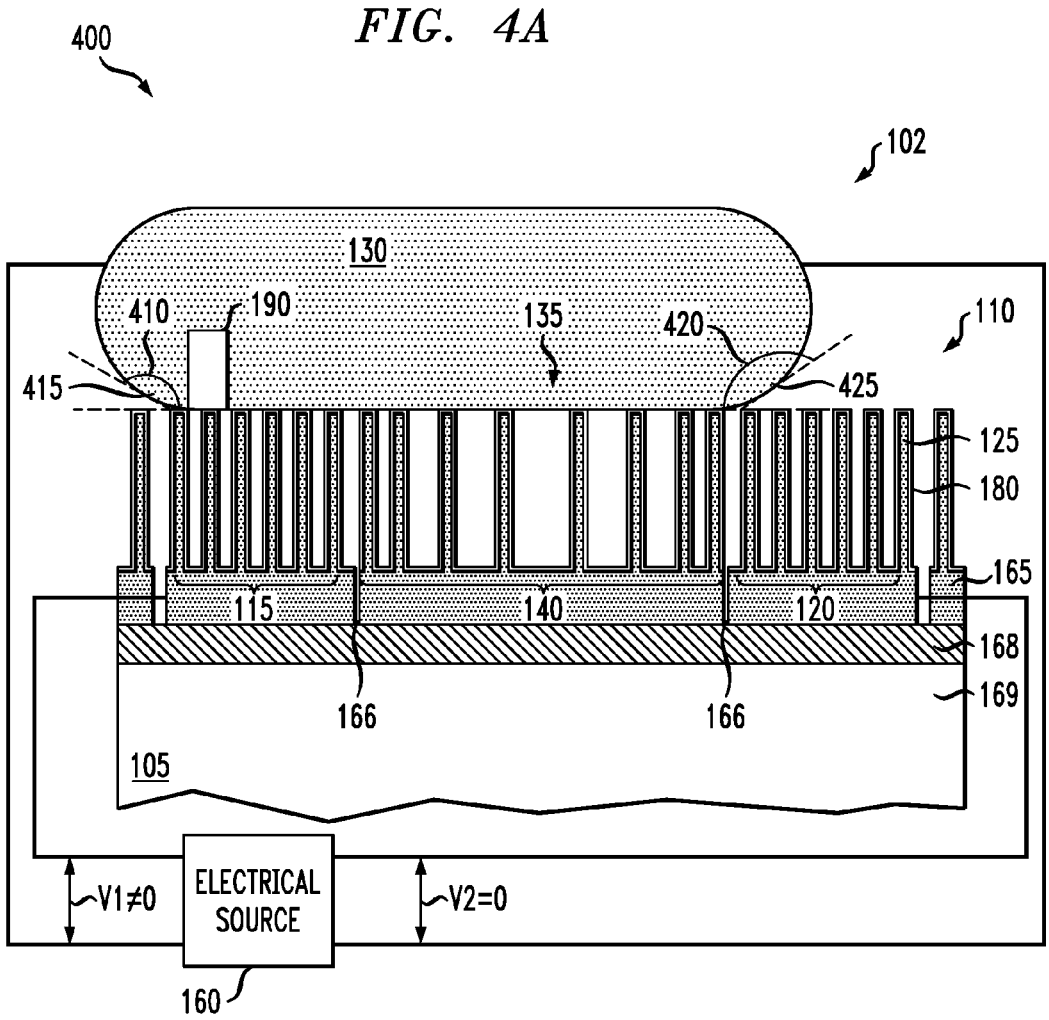
FIGS. 4A-5B present cross-sectional and plan views of an apparatus at various stages of an exemplary method of use.
Figure 4B:
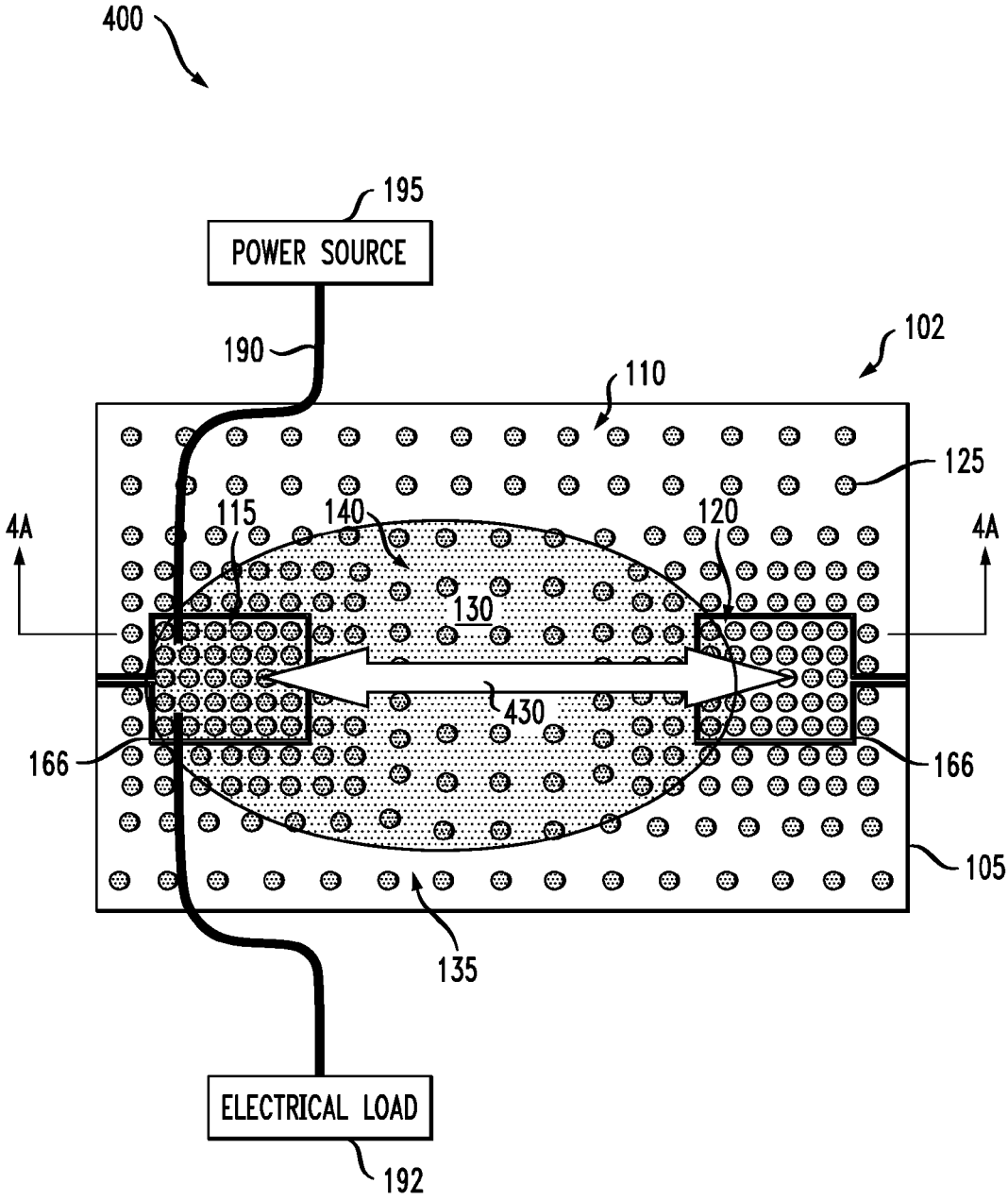
Figure 5A:
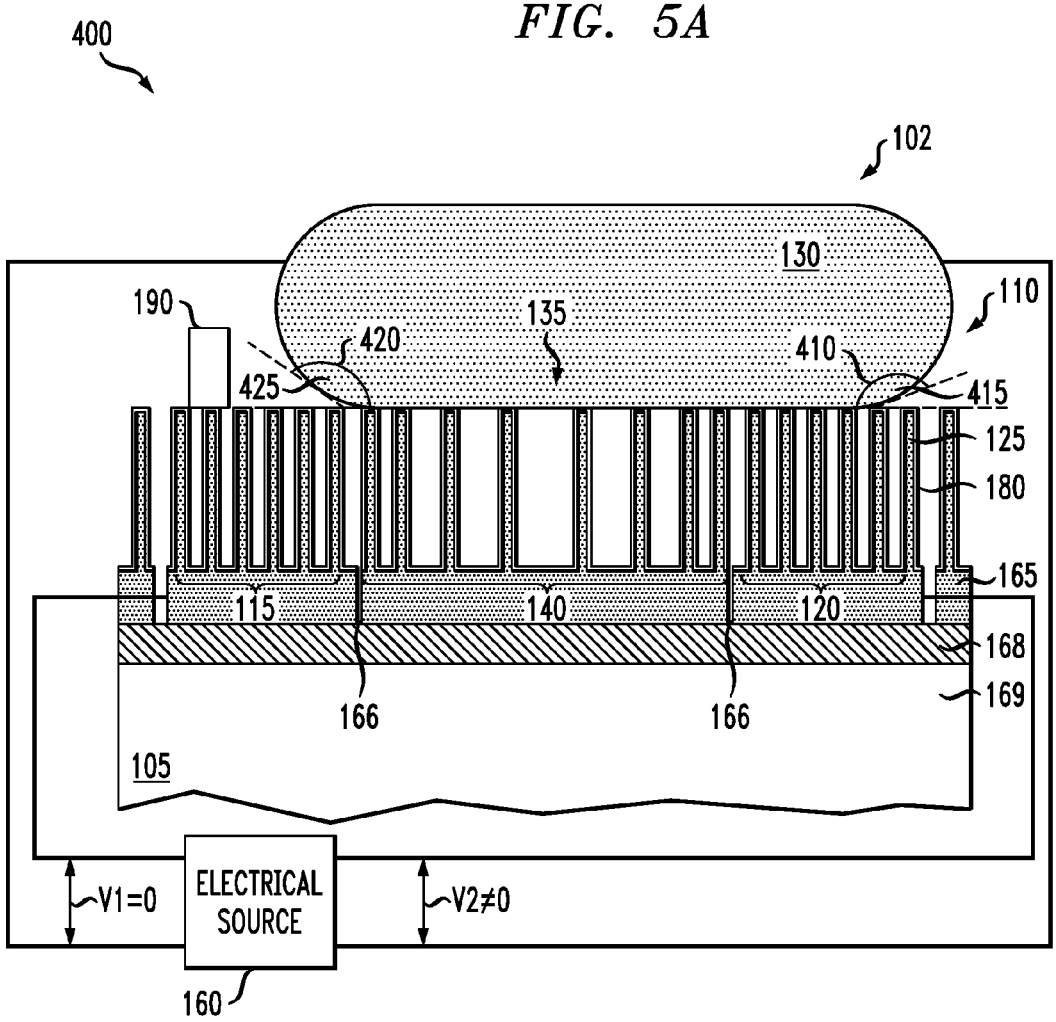
Figure 5B:
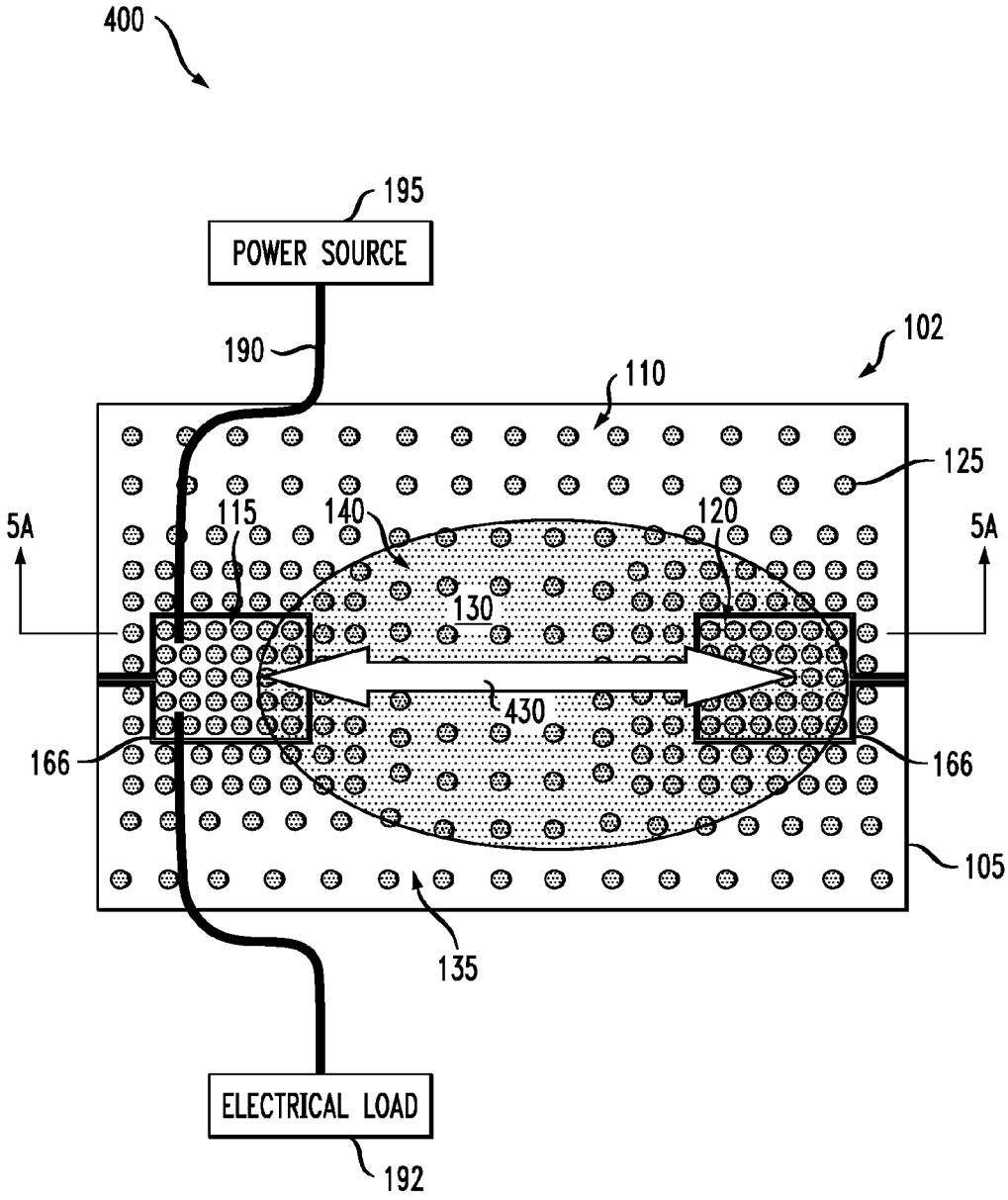

Another embodiment is a method of use. FIGS. 4A and 5A present cross-section views of an exemplary apparatus 400 at various stages of use. FIGS. 4B and 5B present plan views of the apparatus 400 at the same stages of use as in FIGS. 4A and 5A, respectively. The views in FIGS. 4A and 5A are analogous to the cross-sectional views presented in FIG. 1A, and FIGS. 4B and 5B are analogous to the plan views presented in FIG. 1B. Any of the various embodiments of the apparatus discussed above and illustrated in FIGS. 1-3 could be used in the method, however. FIGS. 4A-5B use the same reference numbers to depict analogous structures as shown in FIGS. 1A and 1B.

As illustrated in FIGS. 4A-5B, the method includes reversibly actuating a liquid switch 102. Turning to FIGS. 4A and 4B, illustrated is the apparatus 400 after turning the switch 102 to an on-position by applying a first non-zero voltage (e.g., $V1\neq0$) between a fluid 130 and a first region 115 of a substrate's 105 surface 110 comprising the electrically connected fluid-support-structures 125. The apparatus 400 can have any of the above-described fluid-support-structures discussed in the context of FIGS. 1-3. For instance, each of the fluid-support-structures 125 has at least one dimension of about 1 millimeter or less. Additionally, the first and second regions 115, 120 are electrically isolated from each other.

When the voltage (V1) is applied, the fluid 130 moves towards the first region 115 because the fluid 130 has a lower contact angle 410 at the leading edge 415 of the fluid 130, than the contact angle 420 at the trailing edge 425. Preferably, when the non-zero voltage is applied to the fluid-support-structures 125 of the first region 115, no voltage is applied to the fluid-support-structures 125 of the second region 120 (e.g., $V2=0$). In other cases, however, a non-zero voltage can be applied in the second region 120, so long as it is less than the voltage applied to the first region 115 (e.g., $V2<V1$).

It is preferable for the non-zero applied voltages to be large enough to cause movement of the fluid 130 towards one of the two regions 115, 120, but not so large as to cause wetting of the surface 110, as indicated by the suspended drop having contact angles 410, 420 of less than 90 degrees. Wetting is further discussed in U.S. Patent Applications 2005/0039661 and 2004/0191127, which are incorporated by reference herein in their entirety.

Turning to FIGS. 5A and 5B, illustrated is the apparatus 400 after turning the switch 102 to an off-position by applying a second non-zero voltage (e.g., $V2\neq0$) between the fluid 130 and a second region 120 of the substrate surface 110 that comprises the electrically connected fluid-support-structures 125. Analogous to that discussed in the context of FIGS. 4A-4B, when the voltage (V2) is applied, the fluid 130 moves towards the second region 120 because it has a lower contact angle 410 at the leading edge 415 of the fluid 130, than the contact angle 420 at the trailing edge 425. Also analogous to that discussed above, in some cases when the non-zero voltage is applied to the fluid-support-structures 125 of the second region 120, no (e.g., V1=0) or less (e.g., V1<V2) voltage is applied to the fluid-support-structures 125 of the first region 115.

As illustrated in FIGS. 4A-5B, the switch 102 can be configured to move the fluid 130 over a prescribed path 430 that comprises the first and second regions 115, 120. The fluid 130 can move along the path 430 into the first region 115 and out of the second region 120 when the switch 102 is in the on-position and into the second region 120. The fluid 130 can also move along the path 430 out of the first region 115 when the switch 102 is in the off-position.

As discussed above in the context of FIG. 1B and also illustrated in FIGS. 4B and 5B, their can be a gradient of areal densities of fluid-support-structure 125 along the prescribed path 430. For instance, the areal density of fluid-support-structure 125 can be higher in the first and second regions 115, 120 than in other portions of the surface 110, thereby stabilizing the location of the fluid 130 in one of the on-position or off-position.

As further illustrated in FIG. 4B, the method can further comprise electrically coupling a power source 195 to an electrical load 192 when the switch 102 is in the on-position. This is accomplished for the embodiment presented in FIG. 4B by moving the fluid 130 to first region 115 and contacting the conductive lines 190, thereby completing the electrical connection between the power source 195 and the electrical load 192.

Still another embodiment is a method of manufacture. FIGS. 6-12 present cross-sectional and plan views of an exemplary apparatus 600 at selected stages of manufacture. The cross-sectional and plan views of the exemplary apparatus 600 are analogous to that shown in FIGS. 1A and 1B, respectively. The same reference numbers are used to depict analogous structures to that shown in FIGS. 1A and 1B. Any of the above-described embodiments of the apparatuse can be manufactured by the method.

Figure 6:
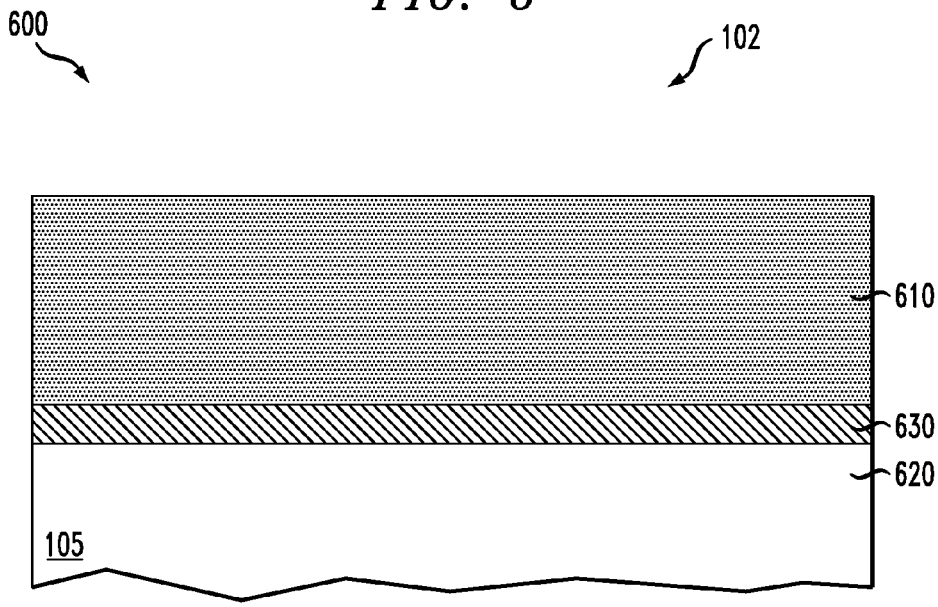
FIGS. 6-12 present cross-sectional and plan views of an exemplary apparatus at selected stages of an exemplary method of manufacture.

The method comprises manufacturing a liquid switch 102 such as illustrated in FIGS. 6-12. The liquid switch 102 can be a component in an apparatus 600, or comprise the apparatus 600 itself. FIGS. 6-10 illustrate exemplary steps in forming a plurality of electrically connected fluid-support-structures on a surface of a substrate. Turning to FIG. 6, shown is a cross-sectional view of the partially-completed apparatus 600 after providing a substrate 105. Preferred embodiments of the substrate 105 comprise silicon or silicon-on-insulator (SOI). The SOI substrate 105 can comprise upper and lower conductive layers 610, 620, comprising silicon, and an insulating layer 630 located therebetween, comprising of silicon oxide.

Figure 7:
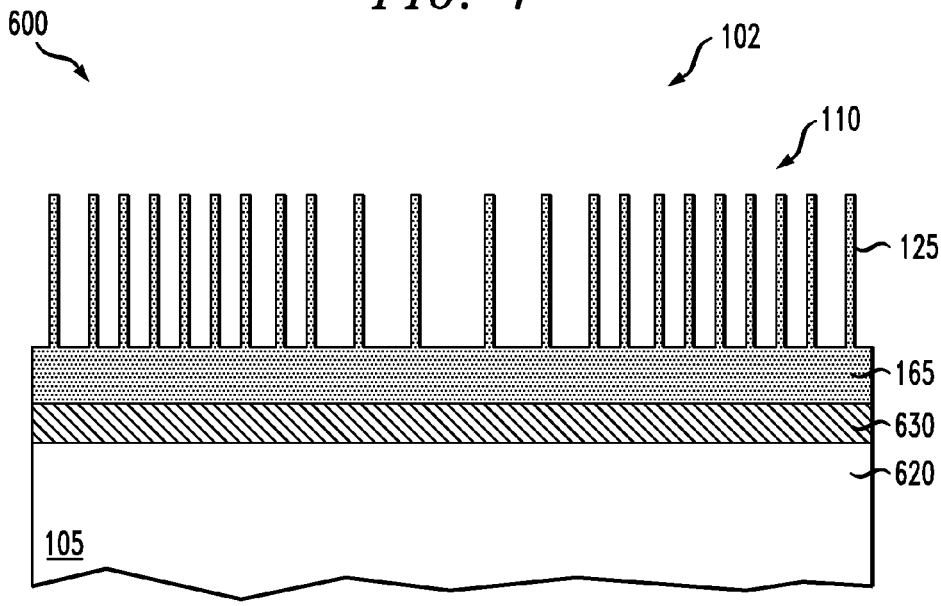

FIG. 7 shows a cross-sectional view of the partially-completed apparatus 600 after patterning a surface 110 of the substrate 105 to form the fluid-support-structures 125. The fluid-support-structures 125 can be formed in the substrate 105, for example, in the upper conductive layer 610 (FIG. 6). Remaining portions of the upper conductive layer 610 that are not part of the fluid-support-structures 125 comprise a base layer 165. Any conventional semiconductor patterning and etching procedures well-known to those skilled in the art can be used. Patterning and etching can comprise photolithographic and wet or dry etching procedures, such as deep reactive ion etching, for example. Each of the fluid-support-structures 125 has at least one dimension of about 1 millimeter or less.

Figure 8:
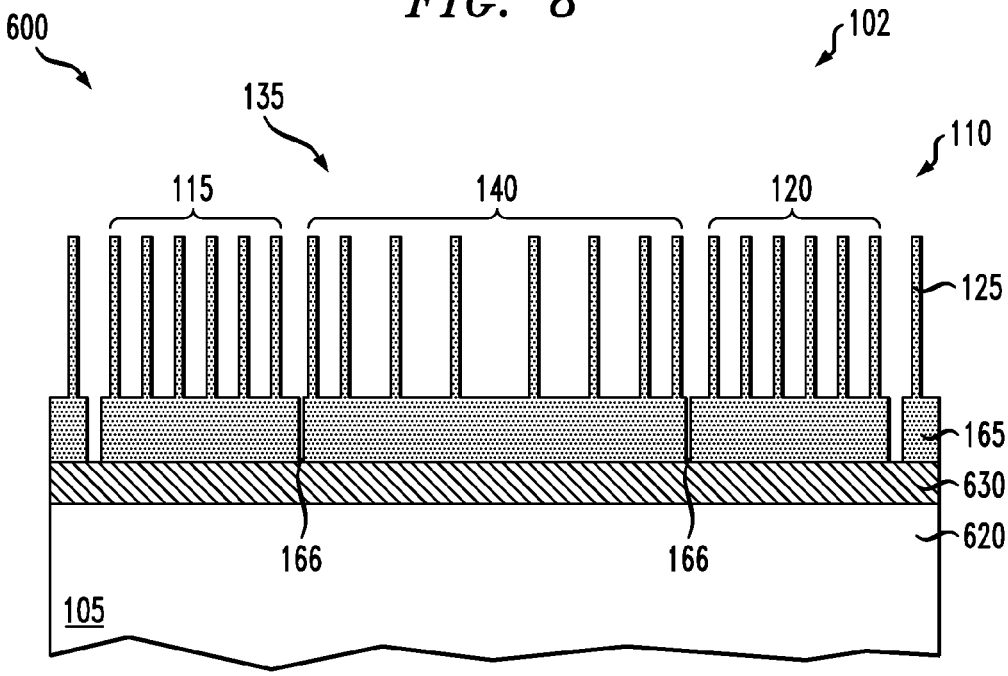
Figure 9:
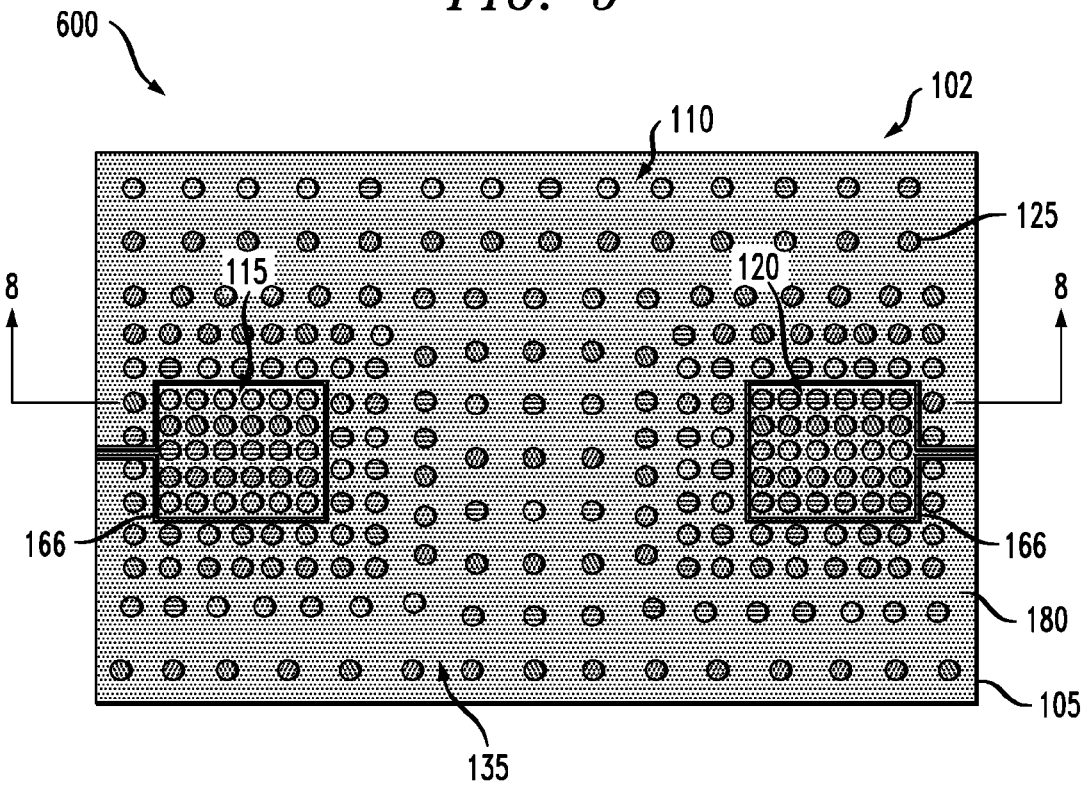

As further illustrated in FIGS. 8 and 9, the method also includes forming first and second regions 115, 120 on the substrate surface 110. FIG. 9 presents a plan view of the partially completed apparatus 600 at the same stage of manufacture as depicted in FIG. 8. The cross-sectional view shown in FIG. 8 corresponds to view line 8-8 in FIG. 9. Each of the regions 115, 120 comprise different ones of electrically connected fluid-support-structures 125 and the regions 115, 120 are electrically isolated from each other.

FIGS. 8-9 show the partially completed apparatus 600 after removing portions of the upper conductive layer 610 to form regions 115, 120 with the electrically connected fluid-support-structures 125 therein. For example, portions of the upper conductive layer 610 have been removed down to the insulating layer 630 to electrically isolate these regions 115, 120 from each other, to form one or more opening 166. For example, as illustrated in FIGS. 8 and 9, a portion of the upper conductive layer 610 that is located in a region 140 between the first and second region 115, 120 has been removed. Similar procedures can be used to electrically isolate these regions 115, 120 from other portions of the conductive base layer 165, if desired. In preferred embodiments of the method, the steps to define and isolate the regions 115, 120 are performed as part of the same patterning procedures to form the fluid-support-structures 125 as described above in the context of FIG. 7. In other cases, however, separated patterning procedures can be used to form and isolate the first and second regions 115, 120.

Figure 10:
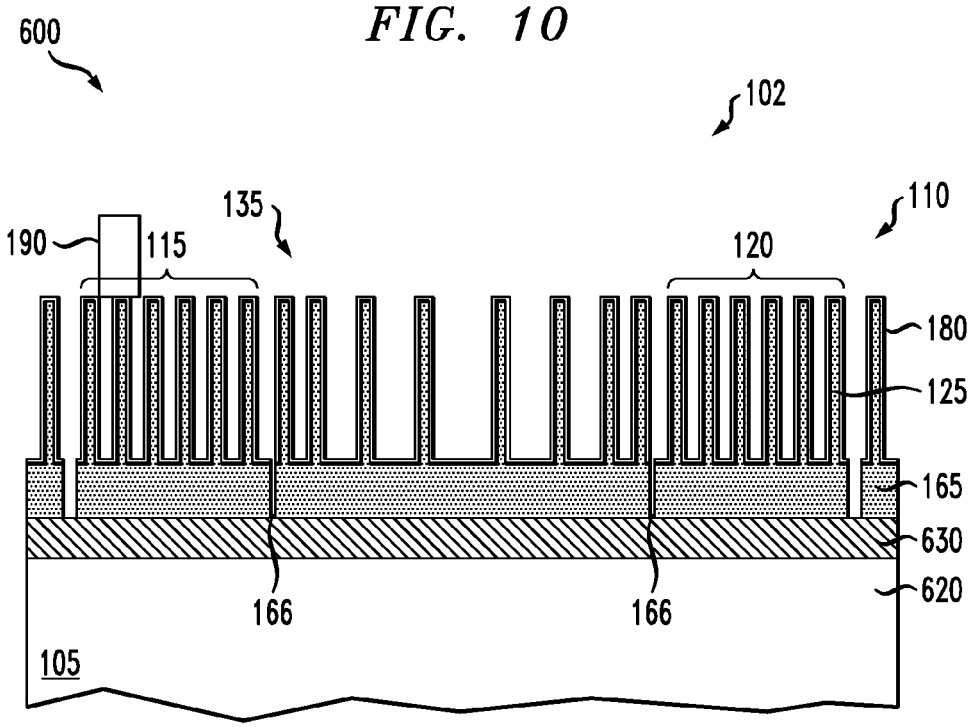
Figure 11:
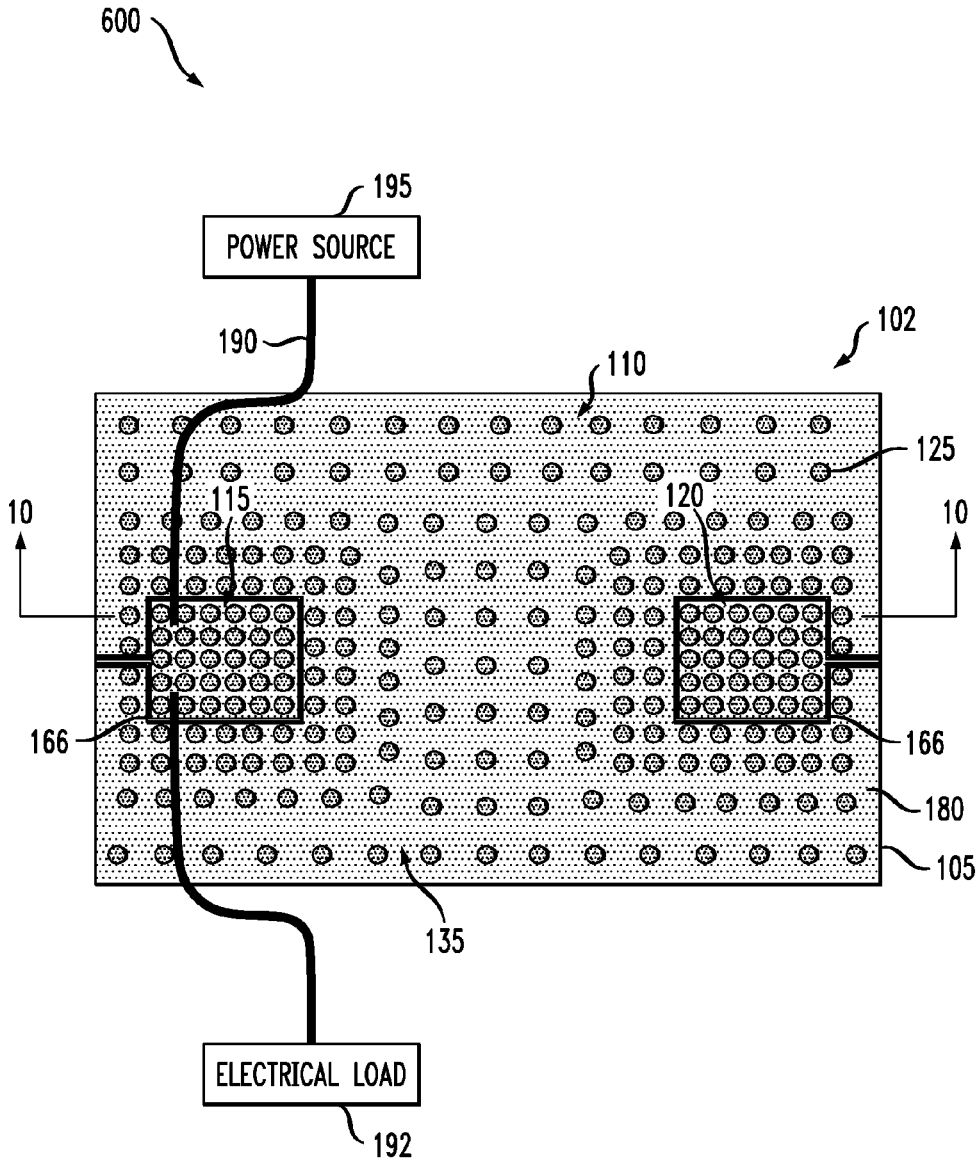

In FIG. 10, depicted is a cross-sectional view of the partially-completed apparatus 600 after forming a coating 180 on each of the fluid-support-structures 125. FIG. 11 presents a plan view of the partially completed apparatus 600 at the same stage of manufacture as depicted in FIG. 10. The cross-sectional view shown in FIG. 10 corresponds to view line 10-10 in FIG. 11. As discussed above in the context of FIG. 1, the coating 180 can comprise insulating and low-surface-energy materials. In some preferred embodiments, the coating 180 conforms to the shape of the fluid-support-structures 125 and also covers the base layer 165.

FIGS. 10 and 11 also show the partially-completed apparatus 600 after forming one or more conductive lines 190 in the first region 115. In some cases the conductive lines 190 comprise gold or other metals deposited through a shadow mask using conventional procedures well-known to those skilled in the art. As illustrated in FIG. 11, the conductive lines 190 can be formed on some of the fluid-support-structures 125 of the first region 115. The conductive lines 190 can formed beyond the first region 115 to electrically couple the switch 102 to a load or power source of the apparatus 600, as discussed in the context of FIG. 1, or to another electrical load 192 or power source 195 that is extraneous to the apparatus 600.

Figure 12:
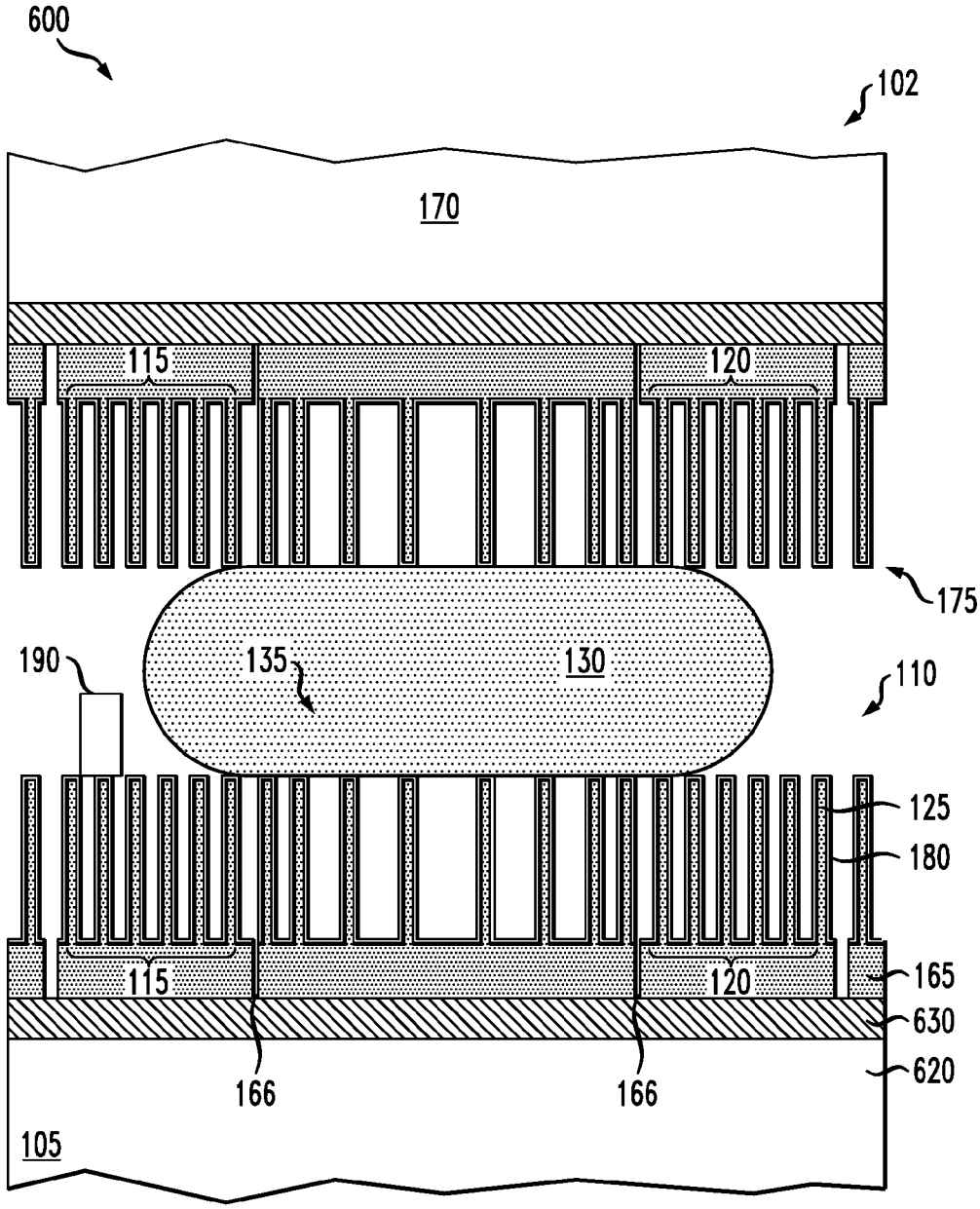

FIG. 12 illustrates a cross-sectional view of the partially-completed apparatus 600 after placing a fluid 130 on the surface 110. The fluid 130 is able to reversibly move between the first and second regions 115, 120, thereby forming an operative switch 102.

FIG. 12 also illustrates the apparatus 600 after physically coupling a second substrate 170 having a second surface 175 to the substrate 105. The substrates 105, 170 are coupled together such that the surface 110 and second surface 175 oppose each other and the fluid 130 is located therebetween. The coupling of the substrates 105, 170 can be facilitated through the use of automated micromanipulators, such as used in the assembly of integrated circuits, of other conventional techniques familiar to one of ordinary skill in the art.

In some cases, the first and second regions 115, 120 are formed on the second surface 175, wherein the first and second regions 115, 120 comprise electrically connected fluid-support-structures 125, and the regions 115, 120 are electrically isolated from each other. In other cases, however, the second surface 175 can be a planar surface having fluid-support-structures 125 thereon or is a planar surface devoid of the fluid-support-structures 125. The fluid-support-structures 125 and first and second regions 115, 120 on the second surface 175 can be formed using the same procedures as presented in FIGS. 6-10.

Although the present invention has been described in detail, those of ordinary skill in the art should understand that they could make various changes, substitutions and alterations herein without departing from the scope of the invention.

What is claimed is:

1. A method, comprising:

reversibly actuating a liquid switch, including:

turning said switch to an on-position by applying a first voltage between a fluid and a first region of a substrate surface having electrically connected fluid-support-structures thereon, wherein each of said fluid-support-structures have at least one dimension of about 1 millimeter or less; and turning said switch to an off-position by applying a second voltage between said fluid and a second region of said substrate surface having said electrically connected fluid-support-structures thereon, wherein said first and second regions are electrically isolated from each other.

2. The method of claim 1, wherein said fluid moves into said first region and out of said second region when said switch is in said on-position.

3. The method of claim 1, wherein said fluid moves into said second region and out of said first region when said switch is in said off-position.

4. The method of claim 1, further including electrically coupling a power source to an electrical load when said switch is in said on-position.

5. The method of claim 4, wherein said power source is configured to separately apply voltages to said fluid-support-structures of said first and second regions.

6. The method of claim 4, wherein said electrical source is configured to apply a non-zero voltage to said fluid-support-structures in one of said first or said second regions and a zero voltage to the other of said first or said second regions.

7. The method of claim 1, wherein said first and second region has an areal density of said fluid-support-structures that is greater than an areal density of said fluid-support-structures in a remaining portion of said surface.

8. The method of claim 1, wherein there is an areal density gradient of said fluid-support-structures between said first and said second regions.

9. The method of claim 1, wherein said first and second regions have a total surface area of top surfaces of said fluid-support-structures that is greater than a total surface area of top surfaces of said fluid-support-structures in a remaining portion of said surface.

10. The method of claim 1, wherein said liquid switch further includes a second substrate having a second surface with said first and second regions thereon, wherein said second surface opposes said surface and said fluid is located therebetween.

11. The method of claim 1, wherein said liquid switch further includes conductive lines configured to couple said liquid switch to an electrical load that comprises an integrated circuit.

12. The method of claim 1, wherein each of said fluid-support-structures comprises a post and said at least one dimension is a lateral thickness of said post.

13. The method of claim 1, wherein each of said fluid-support-structures comprises a cell and said at least one dimension is a lateral thickness of a wall of said cell.

* * * * *